United States Patent [19]

Cook, Jr. et al.

[11] 3,948,737

[45] Apr. 6, 1976

[54] PROCESS FOR ELECTROLYSIS OF BRINE

[75] Inventors: Edward H. Cook, Jr., Lewiston; Alvin T. Emery, Youngstown; Blaine O. Schoepfle, Snyder, all of N.Y.

[73] Assignee: Hooker Chemicals & Plastics Corporation, Niagara Falls, N.Y.

[22] Filed: Oct. 9, 1974

[21] Appl. No.: 513,376

Related U.S. Application Data

[63] Continuation-in-part of Ser. No. 212,171, Dec. 27, 1971, abandoned.

[52] U.S. Cl. ..... 204/98; 204/128

[51] Int. Cl.[2]... C25B 1/16; C25B 1/26; C25B 13/08

[58] Field of Search ..... 204/98, 128

[56] References Cited

UNITED STATES PATENTS 3,773,634 11/1973 Stacey et al. ..... 204/98

*Primary Examiner*—R. L. Andrews

*Attorney, Agent, or Firm*—Peter F. Casella; Herbert W. Mylius

[57] ABSTRACT

In the electrolysis of an alkali metal chloride brine in an electrolytic cell equipped with a permselective ion exchange membrane between the anode and cathode, which membrane is of the perfluorinated sulfonic acid type, improved anode and cathode current efficiencies are obtained with lower power consumption by introducing the aqueous alkali metal chloride solution into the anode compartment at an alkali metal chloride content of at least 250 grams per liter and a pH which is not in excess of about 4.5, which pH is maintained by the addition of hydrochloric acid to the alkali metal chloride solution, and controlling the rate of flow of the solution through the anode compartments such that the alkali metal chloride content of the solution removed from the anode compartment is at least 25 grams per liter less than that of the solution introduced into the compartment. The alkali metal chloride content of this solution is then increased to at least 250 grams per liter by the addition of alkali metal chloride and the pH is reduced to at least 4.5 of the addition of hydrochloric acid and the solution is reintroduced into the anode compartment. Additionally, water is introduced into the cathode compartment, the rate of water addition and the rate of removal of catholyte liquor from the cathode compartment being controlled such that the alkali metal hydroxide content of the catholyte liquor removed is not in excess of about 33% by weight.

10 Claims, No Drawings

PROCESS FOR ELECTROLYSIS OF BRINE

This application is a continuation-in-part of Ser. No. 212,171, filed Dec. 27, 1971, now abandoned.

This invention relates to a process for the electrolysis of aqueous alkali metal chloride solutions in an electrolytic cell which is equipped with a permselective cation exchange membrane and, more particularly, relates to improvements in such a process whereby higher anode and cathode current efficiences are obtained with lower power consumption than has heretofore been possible in such cells.

The electrolysis of aqueous alkali metal chloride solutions in cells equipped with an anode and cathode, separated by a porous diaphragm, is well known in the art. Moreover, it is further known that these porous diaphragms may be replaced with various cation exchange resin membranes that are substantially impervious to both liquids and gases to control both ionic and molecular migration during the electrolysis. Various membranes of the "amberlite type" sulfonated copolymers of styrene and divinyl benzene and the like, have heretofore been disclosed for this purpose in various patents, including U.S. Pat. No. 2,967,807, U.S. Pat. No. 3,390,065 and French Pat. No. 1,510,265. More recently, an improved membrane of the perfluorosulfonic acid type has been disclosed in U.S. Pat. No. 3,282,875 and considerable efforts have recently been extended in attempts to develop satisfactory processes for the elecrolysis of alkali metal chloride brines using such membranes.

Although these efforts have indicated initially that the membranes of the perfluorosulfonic acid type have overcome some of the difficulties encountered with the previous membranes, the anode and cathode current efficiences obtained in the processes have still been unattractively low. Additionally, it has been found that the voltages necessary to effect the electrolytic decomposition of the alkali metal chloride brines are sufficiently high as to cause genuine concern for the commercial feasibility of the processes, particularly in a time of energy conservation. Moreover, the methods devised to overcome these problems have frequently resulted in the production of waste or purge streams whose disposal presents additional problems, particularly under the pollution control laws.

It is, therefore, an object of the present invention to provide an improved process for the electrolysis of aqueous alkali metal chloride solutions to produce chlorine and alkali metal hydroxides which provide relatively high anode and cathode current efficiencies while operating at reduced power consumption.

A further object of the present invention is to provide an improved electrolysis process for the production of chlorine and alkali metal hydroxides which does not present waste disposal problems or require the use of purge streams to control impurity buildup, while still providing improved electrical operating efficiencies.

These and other objects will become apparent to those skilled in the art from a description of the invention which follows.

Pursuant to the above objects, the present invention is an improvement in the process of electrolyzing an aqueous alkali metal chloride solution in an electrolytic cell having an anode compartment containing an anode, a cathode compartment containing a cathode and a substantially fluid impervious permselective cationic membrane barrier separting the anode and cathode compartments, which barrier consists essentially of a hydrolyzed copolymer of tetrafluoroethylene and a sulfonated perfluorovinyl ether having the formula:

$$FSO_2CF_2CF_2OCF(CF_3)CF_2OCF{=}CF_2$$

Said copolymer having an equivalent weight of from about 900 to 1600, which improvement comprises continuously flowing an aqueous alkali metal chloride solution through the anode compartment of said cell, while adding water to the cathode compartment of the cell and passing an electrolytic current between the anode and cathode, introducing said alkali metal chloride solution into the anode compartment at an alkali metal chloride content of at least 250 grams per liter and a pH not in excess of about 4.5, controlling the rate of flow of said solution through the anode compartment so that the alkali metal chloride content of the solution removed from the anode compartment is at least 25 grams per liter less than that of the solution introduced into the anode compartment, adding sufficient alkali metal chloride and hydrochloric acid to the solution removed from the anode compartment to increase the alkali metal chloride content to at least 250 grams per liter and lower the pH to at least 4.5, reintroducing the thus treated solution into the cell anode compartment and controlling the rate of addition of water to the cathode compartment and the rate of removal of catholyte liquor from the cathode compartment such that the alkali metal hydroxide content of the catholyte liquor removed is not in excess of about 33% by weight. In this manner, the electrolysis of the alkali metal chloride solution is carried out to produce chlorine and a substantially chloride free alkali metal hydroxide product at anode and cathode current efficiencies which are in excess of 90%, without the production of a waste stream or purge stream of depleted brine which must then be disposed of.

More specifically, in the practice of the method of the present invention, an aqueous solution of sodium chloride is electrolyzed in a chloralkali cell having an anode compartment containing an anode and a cathode compartment containing a cathode. The compartments are separarted by a barrier that is substantially impervious to fluids and gases and which is a cation exchange membrane that is a hydrolyzed copolymer of tetrafluoroethylene and a sulfonated perfluorovinyl ether having the formula:

$$FSO_2CF_2CF_2OCF(CF_3)CF_2OCF{=}CF_2$$

This copolymer has an equivalent weight of from about 900 to 1600 and preferably from about 1100 to 1400. Copolymers of this type are prepared as disclosed in U.S. Pat. No. 3,282,875, by reacting, at a temperature below about 110° centigrade, a perfluorovinyl ether of the formula:

$$FSO_2CF_2CF_2OCF(CF_3)CF_2OCF{=}CF_2$$

with tetrafluoroethylene in an aqueous liquid phase, preferably at a pH below 8 and in the presence of a free radical initator such as ammonium persulfate. Subsequently, the acyl fluoride groups of the copolymer are hydrolyzed to the free acid or salt form using conventional means.

An alkali metal chloride brine, containing at least 250 grams per liter of the alkali metal chloride and preferably from about 250 to 320 grams per liter is continuously circulated through the anode compartment of the cell. This brine solution has a pH which is not in excess of about 4.5 and preferably has a pH within the range of about 2.5 to 4.0, although pH values as low as 1, or lower, may also be used. The desired pH level in the anolyte solution is achieved and maintained by the addition of hydrochloric acid to the solution. The amount of acid added will, of course, vary, depending upon the pH level which is maintained in the brine solution. Typically, however, the anolyte brine solution will contain from about 2 to 10% by weight of hydrochloric acid and preferably from about 3 to 7% by weight to maintain the desired pH range of 2.5 to 4.0.

The rate of flow of the acidified brine solution through the anode compartment is controlled such that the alkali metal chloride content of the solution which is removed from the anode compartment is at least 25 grams per liter less than that of the solution which is introduced into the anode compartment, and preferably from about 30 to 50 grams per liter less. From the anolyte compartment, the depleted brine is passed through a replenishing zone wherein it is resaturated with the alkali metal chloride, such as sodium chloride to raise the alkali metal chloride content to at least 250 grams per liter and acidified with hydrochloric acid, to lower the pH to at least about 4.5. The replenished brine is then reintroduced into the anode compartment of the cell.

In this manner, there is no disposal problem of the depleted brine, the brine solution being continually replenished and recirculated through the cell. Additionally, by maintaining the pH of the brine solution within the ranges which have been specified hereinabove, the tendency of hydroxyl ions to migrate from the cathode compartment to the anode compartment is minimized and any hydroxy ions which do migrate are neutralized in the anolyte. By this procedure, the formation of sodium chlorate in the anolyte is also minimized and the sodium chlorate content is maintained at a level which can be tolerated in the system without the need for purging a portion of the depleted brine stream in order to effect the chlorate level control. Thus, the process of the present invention operates as a substantially closed system while attaining good anode and cathode current efficiencies with optimum power consumption.

In the operation of the present process, water is introduced into the cathode compartment of the cell. The rate at which the water is added to the cathode compartment and the rate at which the catholyte liquor is removed from the compartment are controlled such that the catholyte liquor has a sodium hydroxide content which is not in excess of about 33% by weight. Preferably, the sodium hydroxide content of the catholyte liquor is within the range of about 24 to 33% by weight, although sodium hydroxide concentrations as low as about 10% by weight can be utilized while still obtaining good cathode current efficiency. Typically, the catholyte liquor obtained from the cathode compartment has a sodium chloride content of less than about 1%.

In general, the present process may be operated over a wide temperature range, temperatures from room temperature up to the boiling point of the electrolyte being typical, although temperatures of from about 65 to 90°C are preferred. Similarly, the electrical operating conditions of the process may also vary over a wide range, cell voltages of from about 2.3 to 5 volts and anode current densities of from about 0.5 to 4 amps per square inch being suitable. In the operation of the process, however, it is found that for any given anode current density used, the cell voltages, and thus the power consumption of the cell, will be less than those required in similar processes which utilize lower sodium chloride concentrations in the anolyte brine and/or no brine acidification.

The electrolytic cells in which the process of the present invention is carried out may be formed of any suitable electrically nonconductive material which is resistant to chlorine, hydrochloric acid, and sodium hydroxide and which will withstand the temperatures at which the cell is operated. Exemplary of materials which may be used are high temperature polyvinyl chloride, polypropylene, hard rubber, chlorendic acid base polyester resins and the like. Preferably, the materials of construction used for the cell have sufficient rigidity as to be self supporting.

In some instances, the cells may be formed of material which does not fulfill all of the above requirements, such as concrete or cement, such materials generally not being resistant to hydrochloric acid and chlorine. Where such materials are used, however, the interior exposed areas are coated with a material which will provide the necessary resistance. Additionally, even in the case of materials which are substantial by self supporting, such as rigid polyvinyl chloride, it may be desirable in some instances, such as where relatively large installations are used, to provide reinforcing members around the exterior of the cell, such as metal bands, to provide additional rigidity.

The electrodes of the cell used in the method of the present invention may be formed of any electrically conductive material which will resist the attack of the sodium hydroxide, chlorine, and hydrochloric acid. Typically, the cathodes may be constructed of steel, although iron, graphite, or other resistant materials may also be used. Similarly, the anodes may be formed of graphite, although, metallic anodes are generally preferred. Typically, such metallic anodes will be formed with a valve metal substrate, such as titanium, which substrate will contain an electrically active coating, such as a coating which contains one or more platinum group metals or platinum group metal oxides. In the most preferred embodiment, the titanium substrate has an electrically active coating which contains ruthenium oxide, with the titanium substrate covering a more conductive metal core, such as steel, copper, aluminum, or the like.

The membranes used in the practice of the present invention, as have been described hereinabove, may be prepared and utilized in the form of a thin film, either as such, or deposited on an inert support, such as a cloth woven of polytetrafluoroethylene, glass fibers, or the like.

The thickness of the supported membrane may be varied over a considerable range, thicknesses of from about 3 to 15 mils being typical. In general, it has been found that a wet, 10 mil thick membrane of the type which has been hereindisclosed has an electrical resistance such that when it is inserted in an operating cell with a gap of about 0.25 inches between the anode and cathode, the voltage increase across the membrane will only be from about 0.5 to 0.7 volts per ampere square inch of the membrane, within the range of about 0.5 to 3 amperes per square inch.

The membrane may be fabricated in any desired shape. As it is generally prepared, the copolymer is obtained in the form of the sulfonyl fluoride. In this non-acid form, the copolymer is relatively soft and plyable and can be seam or butt welded, forming welds which are as strong as the membrane material itself. Preferably, the polymeric material is shaped and formed in the non-acid state. Following shaping or forming into the desired membrane configuration, the material is conditioned for use by hydrolyzing the sulfonyl fluoride groups to free sulfonic acid or sodium sulfonate groups. This hydrolysis may be effected by boiling the membrane in water or in caustic alkaline solution. Upon boiling in water for about 16 hours, it is found that the conditioned membrane material undergoes swelling of about 28%, which swelling is isotropic, about 9 percent in each direction. When the swelled membrane is exposed to the sodium chloride brine, the swelling is reduced to about 22%, resulting in a net tightening of the membrane during use. The conditioning of the membrane, i.e., hydrolysis process, may be carried out either outside of the cell or with the membrane in place in the cell.

In order that those skilled in the art may better understand the method of the present invention and the manner in which it may be practiced, the following specific examples are given. In these examples, unless otherwise indicated, parts and percent are by weight and temperatures are in degrees centrigrade. It is to be appreciated, however, that these examples are not to be taken as a limitation of the method of the present invention but merely as being exemplary of the preferred manner in which the method may be practiced.

EXAMPLE 1

A saturated solution of sodium chloride brine was continuously introduced into the anode compartment of a two compartment electrolytic cell containing a ruthenium oxide coated titanium mesh anode and a steel mesh cathode separated from the anode by a cation active permselective diaphragm of 2.14 sq. in. effective area composed of a 10 mil thick film of a hydrolyzed co-polymer of a co-polymer of tetrafluoroethylene and sulfonated perfluorovinylether of equivalent weight of about 1100, prepared according to U.S. Pat. No. 3,282,875 and conditioned to the free acid form by soaking in boiling water for about 16 hours.

The brine was circulated continuously within the anode compartment through a conduit in communication with the brine inlet and outlet. The cathode compartment was initially filled with diulte aqueous sodium hydroxide containing 50 gpl NaOH. Chlorine gas discharged at the anode was taken off from the anode compartment through the gas vent pipe and hydrogen discharged at the cathode was similarly vented from the cathode compartment. An overflow pipe for removal of caustic liquor was located in the cathode compartment. A cell temperature of about 90 degrees was maintained in the cell which was operated at a current density of about one ampere per square inch of diaphragm. At cetain intervals in the operation of the cell, the current density was increased, as indicated in the following Table, to determine the effect on cell voltage in these instances. Samples of the catholyte liquor were taken at 24 hour intervals and analyzed for sodium hydroxide and sodium chloride concentration. The data from this run are set out in the following Table I.

TABLE I

| TIME hrs. | Days | DIAPHRAGM CURRENT DENSITY amp/sq.in. | VOLTAGE | CATHOLYTE CONTENT gpl NaOH | gpl NaCl |
|---|---|---|---|---|---|
| 24 | 1 | 0.7 | 2.64 | 132.8 | 4.8 |
| 48 | 2 | 0.7 | 2.66 | 200.8 | 9.9 |
| 72 | 3 | 1.0 | 2.77 | 260 | 11.9 |
| | | 2.0 | 3.08 | 260 | 11.9 |
| | | 3.0 | 3.37 | 260 | 11.9 |
| 96 | 4 | 1.0 | 2.84 | 318 | 15.1 |
| 120 | 5 | 1.0 | 2.85 | 358 | 14.5 |
| 192 | 8 | 1.0 | 2.85 | 394 | 15.8 |
| 216 | 9 | 1.0 | 2.95 | 420 | 14.8 |
| 240 | 10 | 1.0 | 2.95 | 472 | 16.0 |
| | | 2.0 | 3.37 | 472 | 16.0 |
| | | 3.0 | 3.74 | 472 | 16.0 |
| 264 | 11 | 1.0 | 2.96 | 448 | 12.0 |

These data indicate the excellent ion selectivity and chemical compatibility of the permselective membrane diaphragm of this invention. Water transport through the membrane evidently restricts the build up of caustic concentration to about 500 gpl.

EXAMPLE 2

The effect of changes in the hydrochloric acid concentration, as measured by the pH of the anolyte, on the caustic efficiency of the electrolysis of brine solutions was studied. This experiment was conducted in a two compartment cell using a ruthenium oxide coated titanium mesh anode and steel mesh cathode separated by a diaphragm consisting of a hydrolyzed co-polymer of tetrafluoroethylene and a perfluorovinyl ether of equivalent weight of about 1100 conditioned to the free acid form by soaking in boiling water, and having an effective area of 30 square inches. The anolyte compartment was fed continuously with a brine solution containing about 250 grams per liter ("gpl") of sodium chloride and sufficient hydrochloric acid to adjust the pH in the anolyte liquor to within the desired range. Adjustments were made daily and each variation in feed was carried on for about 24 hours. The catholyte compartment was fed continuously with water, which together with that water which passed through the membrane by osmosis from the anolyte compartment, maintained the catholyte liquor level constant. Caustic liquor produced in the catholyte liquor flowed from the cell through the over flow pipe continuously and was collected for a period of about 16 hours, and sewered for about 8 hours. The results of this experiment which extended over a period of 57 days are set out in the following table II.

(Note: Sample collections were made on each of 5 successive days in each week. On the two other days the cell was operated continuously under relatively static conditions, the overflow from the cathode compartment being sewered).

EXAMPLE 3

In this example, conditioning of the diaphragm is demonsrated.

a. In the cell

TABLE II

| DAY | SAMPLE COLLECTION PERIOD hrs | CELL TEMP. °C | CD[1] ASI | VOLTAGE | LOAD AMPS | NaCl gpl | ANOLYTE NaCl CONSUMED grams | HCl CONSUMED grams | NaOH REACTED TO FORM $NaClO_3$ grams | pH RANGE AVERAGE |
|---|---|---|---|---|---|---|---|---|---|---|
| 1 | 16.25 | 91 | 2 | 3.72 | 60 | 292 | 2019.64 | 323.09 | — | 1.2.–2.3 |
| 2 | 16.25 | 80 | 2 | 2.63 | 60 | 284.5 | 1803.69 | 470.38 | — | 2.7–2.1 |
| 4 | 16.25 | 80 | 2 | — | 60 | 278 | 2010 | 205.5 | 128.7 | 4.0–4.4 |
| 5 | 17.0 | 82 | 2 | 3.7 | 60 | 263 | 2103 | 171.3 | 114.2 | 4.0–4.3 |
| 8 | 16.5 | 80 | 2 | 3.65 | 60 | 291 | 1959.5 | 42.4 | 226.86 | 3.5–4.3 |
| 9 | 16.5 | 81 | 2 | 3.65 | 60 | 286 | 2103.9 | 436.16 | 0 | 1.9–1.7 |
| 11 | 13.0 | 80 | 2 | 3.62 | 57 | 271 | 1580.4 | 398.85 | 0 | 3.0–1.3 |
| 12 | 16.5 | 91 | 2 | 3.55 | 60 | 253 | 2112.89 | 327 | 96.83 | 1.7–1.9 |
| 15 | 16.5 | 91 | 1 | 3.11 | 30 | — | — | — | — | 2.4–1.9 |
| 16 | 21 | 81 | 2 | 3.78 | 56 | — | — | — | — | 3.6–4.1 |
| 17 | 16.5 | 61–37 | 2 | 4.17–4.88 | 50 | — | — | — | — | 3.5–3.7 |
| 18 | 16.5 | 60–39 | 2 | 4.13–4.80 | 51 | — | — | — | — | 3.8–4.1 |
| 22 | 16.5 | 90 | 2 | 3.66 | 57 | 257 | 1965.65 | 207.9 | 53.33 | 2.3–4.0 |
| 23 | 16.25 | 80 | 2 | 3.85 | 59 | 278 | 2024.55 | 513.5 | 0 | 2.8–1.4 |
| 24 | 16.5 | 81 | 2 | 3.93 | 59 | 265 | 2105.53 | 432.1 | 0 | 3.1–2.8 |
| 25 | 17.75 | 83 | 2 | 3.80 | 59 | 252 | 2152.15 | 416.2 | 146.63 | 2.7–3.5 |
| 30 | 16.5 | 86 | 2 | 3.95 | 62 | 241 | 2122.71 | 459.1 | 0 | 2.1–2.7 |
| 31 | 16.5 | 81 | 2 | 3.72 | 57 | 299 | 1931.3 | 501.3 | 0 | 1.6–3.0 |
| 32 | 16.5 | 81 | 2 | 3.77 | 65 | — | — | 357.5 | 152.16 | 3.2–4.0 |
| 33 | 16.5 | 81 | 2 | 3.86 | 59 | — | — | 335.6 | 0 | 3.9–3.7 |
| 38 | 16.5 | 76 | 1 | 3.31 | 32 | — | — | 342.6 | — | 2.3–3.9 |
| 47 | 16.5 | 85 | 2 | 3.70 | 60 | — | — | — | — | — |
| 48 | 16.75 | 85 | 2 | 4.00 | 62.5 | — | — | — | — | 3.0–4.0 |
| 49 | 17 | 79 | 2 | 3.88 | 57.5 | — | — | 85.37 | — | 3.5–4.2 |
| 50 | 16.75 | 78 | 2 | 3.92 | 57.5 | 291 | — | 99.65 | — | 2.7–4.1 |
| 53 | 17 | 80 | 2 | 4.0 | 58 | — | — | — | — | 4.2–4.1 |
| 54 | 17 | 81 | 2 | 5.88 | 58.75 | — | — | — | 0 | 105–2.85 |
| 55 | 16.5 | 79 | 2 | 3.96 | 59 | 264 | 1993.87 | 296.66 | 0 | 1.7–4.2 |
| 57 | 16 | 81 | 2 | 4.22 | 55 | 231 | 1818.41 | 110.67 | 0 | 2.0–2.6 |

Note: Blank spaces "—" in this Table indicates that the pertinent data were not determined.

[1]Diaphragm current density

CATHOLYTE

| ANODE EFFICIENCY CHLORIDE ASSAY | GAS ANALYSIS | $NaClO_3$ gpl | NaOH gpl | NaCl gpl | $H_2O$ ADDED GRAMS | $H_2O$ OSMOSIS GRAMS | NaOH NEUTRALIZED GRAMS | NaOH PRODUCED GRAMS | NaOH EFFICIENCY % |
|---|---|---|---|---|---|---|---|---|---|
| 99.1 | 96.3 | — | 268 | 0.46 | — | — | 334.5 | 1050 | 74.1 |
| 96.9 | 94.8 | — | 298 | 0.66 | 1880 | 420 | 516.19 | 754 | 59.3 |
| 97.8 | — | 1.75–2.2 | 310 | 0.74 | 1550 | 530 | 225.5 | 738 | 51.6 |
| 97.8 | — | 1.8–2.2 | 227 | 0.53 | 1780 | 760 | 188.0 | 956 | 64.8 |
| 93.9 | 94.8 | 0.35–1.25 | 273 | 0.53 | 2980 | 545 | 46.5 | 884 | 61.8 |
| 97.45 | — | 0.6 | 260 | 0.46 | 2740 | 560 | 478.6 | 887 | 60 |
| 97.8 | 99.2 | 0.55 | 226 | 0.61 | 2685 | 525 | 437.7 | 692 | 62.67 |
| 97.87 | — | 0.65–0.9 | 257 | 0.51 | 3090 | 650 | 358.9 | 884 | 59.7 |
| — | — | — | 263 | 1.0 | 1810 | 260 | — | 471 | 64.1 |
| — | 88.4 | — | 250 | 0.53 | 3475 | 640 | — | 1053 | 60.1 |
| — | — | — | 247 | 0.23 | 2670 | 690 | — | 757 | 61.6 |
| — | — | — | 251 | 0.18 | 2740 | 750 | — | 790 | 62.9 |
| 95.84 | — | 0.7–0.9 | 278 | 0.35 | 2380 | 505 | 228.2 | 844.6 | 60.1 |
| 96.83 | — | 1.4 | 323 | 0.45 | 2320 | 565 | 563.5 | 870 | 60.7 |
| 99.18 | — | 1.4 | 346 | 0.43 | 1782 | 725 | 474 | 883 | 60.7 |
| 94.26 | — | 1.2–1.73 | 381 | 0.49 | 1630 | 825 | 456.7 | 920 | 58.8 |
| 95.17 | — | 1.45 | 420 | 0.33 | 1400 | 580 | 503.8 | 948 | 62.1 |
| 94.18 | — | 0.45 | 365 | 0.78 | 1450 | 580 | 550 | 770 | 55.0 |
| — | — | 0.4–0.9 | 415 | 0.47 | 1595 | 820 | 392 | 962 | 60.3 |
| — | — | 0.9 | 406 | 0.37 | 1455 | 790 | 368 | 875 | 60.1 |
| — | — | — | 403 | 0.43 | 790 | 475 | 376 | 481 | 61.1 |
| — | — | — | 250 | 0.24 | 1945 | 665 | — | 954 | 64.3 |
| — | — | — | 195 | 0.16 | 5250 | 670 | — | 1107 | 70.84 |
| — | — | 1.20 | 159 | 0.15 | 6605 | 645 | 93.68 | 1080 | 74.02 |
| — | — | 1.30 | 140 | 0.15 | 7100 | 745 | 109.3 | 1076 | 74.85 |
| — | — | — | 291 | — | 2540 | 670 | — | 914.5 | 62.2 |
| 99.87 | — | 2.0 | 130 | 0.23 | 7800 | 1155 | 395 | 1015 | 68.09 |
| 99.94 | — | 1.3 | 124 | 0.19 | 7660 | 1165 | 326 | 1096 | 75.45 |
| 94.77 | — | 1.3 | 106 | 0.27 | 8600 | 1205 | 121.5 | 1053 | 80.15 |

The electrolysis cell was prepared in which a diaphragm comprising the membrane in the unconditioned state, i.e., the copolymer material contained sulfonyl fluoride end groups was utilized. The cell was filled with 10 percent aqueous caustic soda and heated to and maintained at 60° to 80° for at least 24 hours. The sulfonyl fluoride groups were converted to sodium sulfonate groups. The caustic solution in the anode compartment was replaced with a sodium chloride brine solution and the electrolysis carried out as described in Example 1 above.

b. Out of the cell

The sulfonyl fluoride membrane was installed in a frame or other holding means and the assembly was immersed in about 10 percent aqueous caustic soda solution at 60° to 80° for about three days. The assembly was then installed in the electrolysis cell and the cell charged with brine in the anode compartment and dilute aqueous caustic soda in the cathode compartment. The elecgtrolysis was then carried out as descrived in Example 1 above.

EXAMPLE 4

The cell of Example 1 was utilized. The operating conditions of the cell were maintained the same as in Example 1 except that hydrochloric acid was added to the feed brine. The effect of anolyte pH on anode current efficiency (measured by gas analysis) and on sodium chlorate concentration in the anolyte was determined. The results are as follows:

| pH | gpl NaOH | Anode Current Efficiency | gpl $NaClO_3$ |
|---|---|---|---|
| 2.5 | 120 | 99.3 | 0.1 |
| 2.5 | 160 | 97.5 | 0.1 |
| 2.5 | 200 | 95.1 | 0.1 |
| 3.0 | 120 | 98.6 | 0.2 |
| 3.0 | 160 | 96.7 | 0.2 |
| 3.0 | 200 | 94.5 | 0.2 |
| 3.5 | 120 | 97.2 | 0.25 |
| 3.5 | 160 | 95.4 | 0.25 |
| 3.5 | 200 | 93.0 | 0.25 |
| 4.0 | 100 | 95.8 | 0.4 |
| 4.0 | 120 | 95.1 | 0.4 |
| 4.0 | 160 | 93.2 | 0.4 |
| 4.0 | 200 | 91.0 | 0.5 |

What is claimed is:

1. In a process wherein an aqueous alkali metal chloride solution is electrolyzed in an electrolytic cell having an anode compartment containing an anode, a cathode compartment containing a cathode and a substantially fluid impervious permselective barrier separating the anode and cathode compartments, which barrier consists essentially of a hydrolyzed copolymer of tetrafluoroethylene and a sulfonated perfluorovinyl ether having the formula:

$$FSO_2CF_2CF_2OCF(CF_3)CF_2OCF{=}CF_2$$

said copolymer having an equivalent weight of from about 900 to 1600, the improvement which comprises continuously flowing an aqueous alkali metal chloride solution through the anode compartment of said cell, while adding water to the cathode compartment of said cell and passing an electric current between the anode and cathode, introducing said alkali metal chloride solution into the anode compartment at an alkali metal chloride content of at least 250 grams per liter and a pH not in excess of 4.5, controlling the rate of flow of said solution through the anode compartment so that the alkali metal chloride content of the solution removed from the anode compartment is at least 25 grams per liter less than that of the solution introduced into the anode compartment, adding sufficient alkali metal chloride and hydrochloric acid to the solution removed from the anode compartment to increase the alkali metal chloride content to at least 250 grams per liter and lower the pH to at least 4.5, reintroducing the thus-treated solution into the cell anode compartment, and controlling the rate of addition of water to the cathode compartment and the rate of removal of catholyte liquor from the cathode compartment such that the alkali metal hydroxide content of the catholyte liquor removed is not in excess of about 33% by weight.

2. The process as claimed in claim 1 wherein the pH of the alkali metal chloride solution in the anode compartment is maintained by the addition of hydrochloric acid.

3. The process as in claim 2 wherein the alkali metal chloride solution introduced into the anode compartment has an alkali metal chloride content within the range of about 250 to 320 grams per liter and a pH within the range of 2.5 to 4.0.

4. The process as claimed in claim 3 wherein the alkali metal chloride content of the solution removed from the anode compartment is from about 30 to 50 grams per liter less than the alkali metal chloride content of the solution introduced into the anode compartment.

5. The process as claimed in claim 4 wherein the alkali metal hydroxide content of the catholyte solution removed from the cathode compartment is from about 24 to 33% by weight.

6. The process as claimed in claim 5 wherein the alkali metal chloride is sodium chloride and the alkali metal hydroxide is sodium hydroxide.

7. The process as claimed in claim 6 wherein the electric current is passed between an anode having a valve metal substrate coated with an activating coating containing at least one material selected from platinum group metals and platinum group oxides, and the cathode.

8. The process as clained in claim 3 wherein the alkali metal hydroxide content of the catholyte solution removed from the cathode is from about 24 to 33% by weight.

9. The process as claimed in claim 8 wherein the alkali metal chloride is sodium chloride and the alkali metal hydroxide is sodium hydroxide.

10. The process as claimed in claim 9 wherein the electric current is passed between an anode having a valve metal substrate coated with an activating coating containing at least one material selected from platinum group metals and platinum group metal oxides, and the cathode.

* * * * *